US007200970B2

(12) United States Patent
Koenig, Jr. et al.

(10) Patent No.: US 7,200,970 B2
(45) Date of Patent: Apr. 10, 2007

(54) COMBINATION COMPRISING VERTICAL WALL, HORIZONTAL CEILING, AND CROWN MOLDING MEMBER HAVING PLANAR PORTION, INTERMEDIATE PORTION, AND MOUNTING FLANGE

(75) Inventors: Joseph M. Koenig, Jr., Glenview, IL (US); Mark Budzik, Niles, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 434 days.

(21) Appl. No.: 10/850,225

(22) Filed: May 20, 2004

(65) Prior Publication Data

US 2005/0183352 A1 Aug. 25, 2005

Related U.S. Application Data

(63) Continuation-in-part of application No. 10/774,798, filed on Feb. 9, 2004.

(51) Int. Cl.
*E04B 2/00* (2006.01)
*E04B 1/00* (2006.01)
*E04C 2/38* (2006.01)

(52) U.S. Cl. ..... 52/287.1; 52/718.01; 52/288.1; 52/255

(58) Field of Classification Search ..... 52/287.1, 52/288.1, 716.1, 718.01, 717.01, 718.04, 52/717.06, 255, 364
See application file for complete search history.

(56) References Cited

U.S. PATENT DOCUMENTS 388,286 A * 8/1888 Kinnear ..... 52/288.1
417,949 A * 12/1889 Sagendorph ..... 52/288.1
906,218 A 12/1908 Goddard
1,856,167 A * 5/1932 Overholtz ..... 403/292
3,201,910 A * 8/1965 Keesee ..... 52/287.1
5,398,469 A 3/1995 Logan
5,426,901 A * 6/1995 Indracek ..... 52/288.1
5,433,048 A * 7/1995 Strasser ..... 52/288.1
5,457,923 A 10/1995 Logan et al.
5,694,726 A * 12/1997 Wu ..... 52/287.1
5,740,642 A * 4/1998 Koenig et al. ..... 52/255
5,904,016 A * 5/1999 Koenig et al. ..... 52/255
6,253,510 B1 * 7/2001 Santarossa ..... 52/287.1

(Continued)

OTHER PUBLICATIONS

Two pages copied from Trim-Tex 2003-2004 Catalog—see Stock Nos. 7208,7258,7250,7360, 7068, 7066, 7062—admitted prior art.

*Primary Examiner*—Naoko Slack
*Assistant Examiner*—Elizabeth A. Plummer
(74) *Attorney, Agent, or Firm*—Wood, Phillips, Katz, Clark & Mortimer

(57) ABSTRACT

As used to trim a corner where a wall and a ceiling meet, a crown molding member has a planar portion, an intermediate portion, and a mounting flange. The planar portion is attached to the ceiling, in a first mode, or to the wall, in a second mode. The intermediate portion may have a coved, stepped, or curved profile. The mounting flange is attached to the wall, in the first mode, or to the wall, in the second mode. When applied to the mounting flange, drywall-finishing material, so-called "mud" in trade parlance, is pressed through apertures in the mounting flange, against the wall, in the first mode, or against the ceiling, in the second mode.

13 Claims, 2 Drawing Sheets

U.S. PATENT DOCUMENTS 6,477,818 B1 11/2002 Jensen
6,643,990 B2 11/2003 Jensen
6,837,020 B1 * 1/2005 Keddell ..... 52/745.2
2004/0045239 A1 * 3/2004 Milu ..... 52/311.1

* cited by examiner

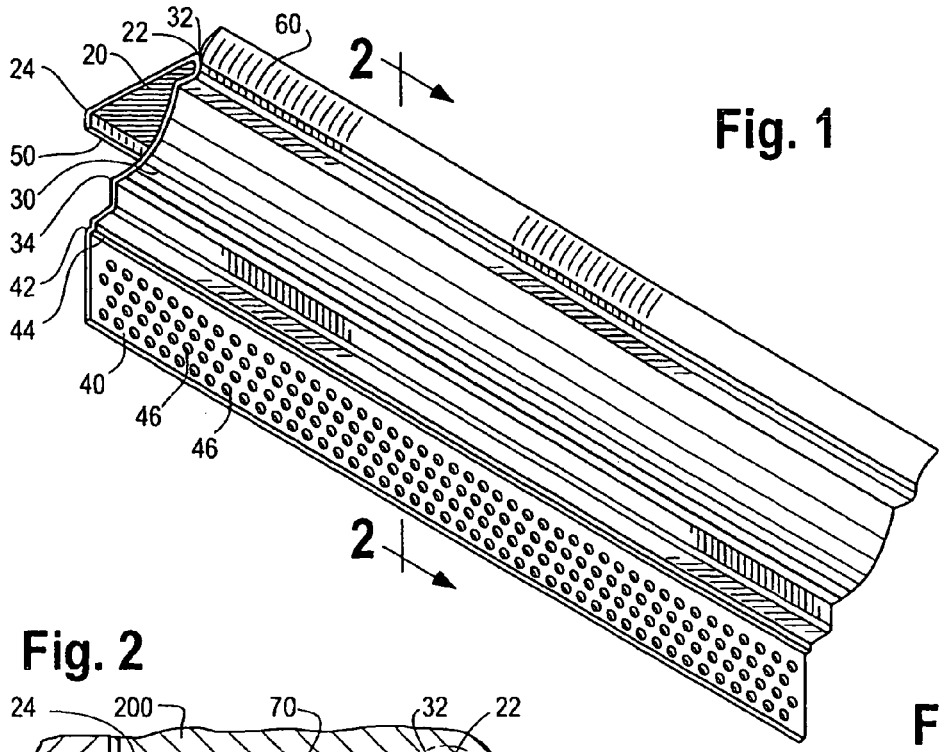
Fig. 1
Fig. 2
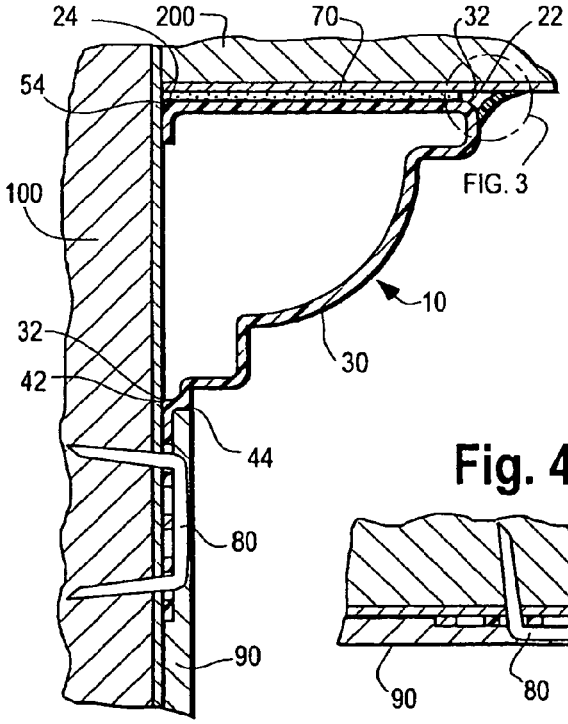
Fig. 3
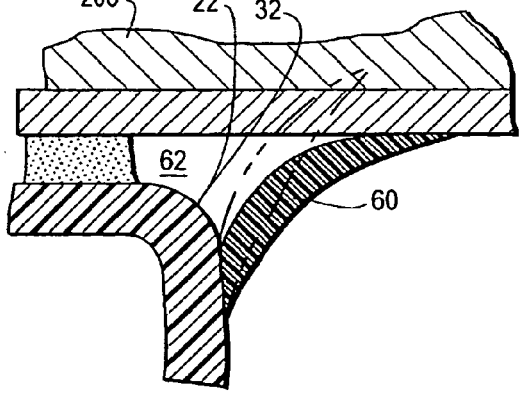
Fig. 4
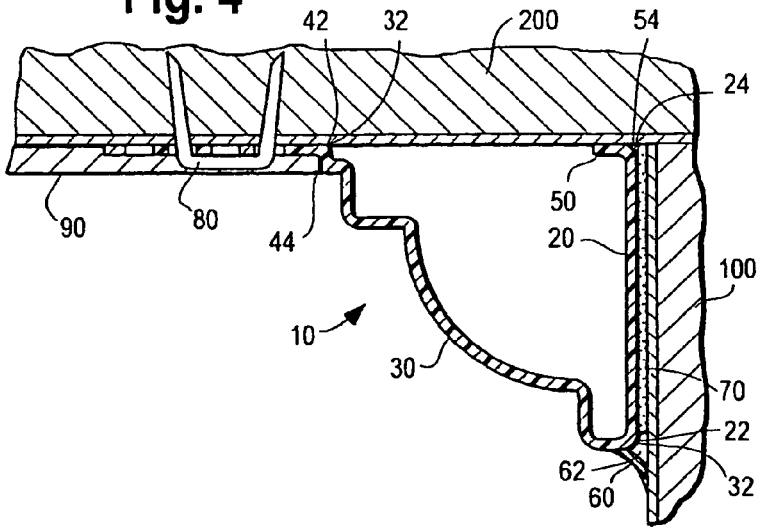

COMBINATION COMPRISING VERTICAL WALL, HORIZONTAL CEILING, AND CROWN MOLDING MEMBER HAVING PLANAR PORTION, INTERMEDIATE PORTION, AND MOUNTING FLANGE

CROSS-REFERENCE TO RELATED APPLICATION

This application is a continuation-in-part of U.S. patent application Ser. No. 10/774,798, which was filed on Feb. 9, 2004, and the disclosure of which is incorporated by reference.

TECHNICAL FIELD OF THE INVENTION

This invention pertains to a combination comprising a vertical wall, a horizontal ceiling meeting the vertical wall so as to define a corner, and a crown molding member trimming the corner. This invention contemplates that the crown molding member has a planar portion, an intermediate portion, and a mounting flange.

BACKGROUND OF THE INVENTION

A crown molding member of the type noted above is exemplified in U.S. Pat. No. 6,477,818 B1 and U.S. Pat. No. 6,643,990 B2, which disclose that an upper, horizontal, "alignment" portion of the crown molding member is attached adhesively to a ceiling panel, via a tape coated on both sides with an adhesive, that a back edge of the upper, horizontal, "alignment" portion abuts a wall panel but is not attached to the wall panel, and that a lower edge of an angled face of the crown molding member abuts the wall panel but is not attached to the wall panel.

SUMMARY OF THE INVENTION

This invention provides a combination comprising a vertical wall, a horizontal ceiling meeting the vertical wall so as to define a corner, and a crown molding member trimming the corner. The crown molding member has a planar portion having a proximal edge and having a distal edge, which is spaced from the proximal edge of the planar portion. The crown molding member has an intermediate portion, which adjoins the distal edge of the planar portion at a distal edge of the intermediate portion. The intermediate portion has a proximal edge, which is spaced from the distal edge of the intermediate portion. The crown molding member has a mounting flange, which adjoins the proximal edge of the intermediate strip at an adjoining edge of the mounting flange.

Preferably, the intermediate portion has a coved, curved, stepped, or other non-straight profile. Preferably, the mounting flange has an array of apertures, through at least some of which drywall finishing material, if applied to the mounting flange, can be pressed against the vertical wall, in the first mode, or against the horizontal ceiling, in the second mode.

When the crown molding member is installed in a first mode, the planar portion extends along and is attached to the horizontal ceiling, the proximal edge of the planar portion is proximal to the vertical wall, and the mounting flange extends along and is attached to the vertical wall, away from the horizontal ceiling. When the crown molding member is installed in a second mode, the planar portion extends along and is attached to the vertical wall, the proximal edge of the planar portion is proximal to the horizontal ceiling, and the mounting flange extends along and is attached to the horizontal ceiling, away from the vertical wall.

When the crown molding member is installed in the first mode, the planar portion may be attached to the horizontal ceiling adhesively, mechanically, or adhesively and mechanically, and the mounting flange may be attached to the vertical wall adhesively, mechanically, or adhesively and mechanically, as well as by drywall finishing material, if and as applied in a manner discussed above. When the crown molding member is installed in the second mode, the planar portion may be attached to the vertical wall adhesively, mechanically, or adhesively and mechanically, and the mounting flange may be attached to the horizontal ceiling adhesively, mechanically, or adhesively and mechanically, as well as by drywall finishing material, if and as applied in a manner discussed above.

Preferably, the crown molding member is extruded from a polymeric material, such as polyvinyl chloride. Thus, whether the crown molding member is installed in the first mode, as described above, or in the second mode, as described above, the crown molding member has sufficient flexibility to provide an expansion joint, which conceals a small gap if and when created, as by settling or shifting, at the corner where the vertical wall and the horizontal ceiling meet.

BRIEF DESCRIPTION OF THE DRAWINGS

FIG. 1 is an isometric view of a crown molding member embodying this invention. As illustrated in FIG. 1, the crown molding member has an arbitrary length, which is exemplary, not limiting.

FIG. 2 is a sectional view taken along line 2—2 of FIG. 1, in a direction indicated by arrows, and showing the crown molding member, as installed in a first implementation of the first mode, so as to trim an interior corner where a wall and a ceiling meet. FIG. 3, on a larger scale, is a detail taken where indicated in FIG. 2.

FIG. 4 is a sectional view, which is taken similarly, and which shows the crown molding member, as installed in a second mode, so as to trim an interior corner where a wall and a ceiling meet.

DETAILED DESCRIPTION OF THE ILLUSTRATED EMBODIMENTS

Figure 5:
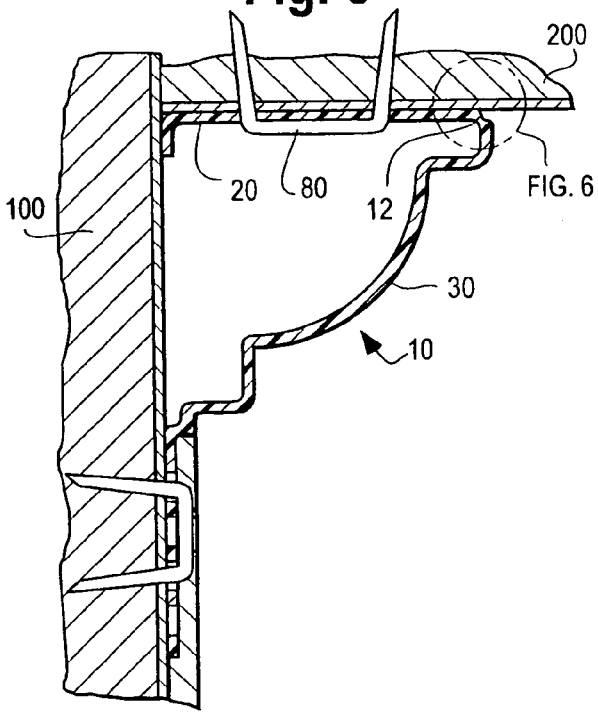
FIG. 5 is a sectional view, which is taken similarly, and which shows the crown molding member, as installed in a second implementation of the first mode, so as to trim an interior corner where a wall and a ceiling meet.

As illustrated in FIG. 1, a crown molding member 10 embodying this invention has a planar portion 20, which has a distal edge 22 and a proximal edge 24, an intermediate portion 30, which has a distal edge 32 adjoining the distal edge 22 of the planar portion 20 and which has a proximal edge 34, which is spaced from the distal edge 32 of the intermediate portion 30, a mounting flange 40 having an adjoining edge 42 adjoining the distal edge 34 of the intermediate portion 30, an additional flange 50 having an adjoining edge 54 adjoining the proximal edge 24 of the planar portion 20, and a flexible fin 60 projecting from the intermediate portion 30, near the distal edge 32 of the planar portion 30.

The intermediate portion 30 may have a coved, curved, or stepped profile or an arbitrary profile. A step 44 is defined where the adjoining edge 42 of the mounting flange 40 adjoins the proximal edge 34 of the intermediate portion 30. The mounting flange 40 has an array of apertures 46, such as circular holes, which are illustrated, or such as elongate slots. The flexible fin 60 is co-extruded with the other portions of the crown molding member 10.

Preferably, except for the flexible fin 60 and except for a so-called "living" hinge, if provided, as discussed below, the crown molding member 10 is extruded so as to have a substantially uniform thickness of approximately 0.060 inch to approximately 0.070 inch, except as discussed below. Preferably, the flexible fin 60 and the other portions of the crown molding member are co-extruded, the flexible fin 60 being extruded from a comparatively softer, more flexible, polymeric material, such as polyvinyl chloride having a hardness of Durometer 92 Shore A and the other portions of the crown molding member 10 being extruded from a comparatively harder, less flexible, polymeric material, such as polyvinyl chloride having a hardness of Durometer Shore 82 D.

As illustrated in FIG. 2, the crown molding member 10 is installed in a first mode, so as to trim an interior corner where a wall 100 and a horizontal ceiling 200 meet. The vertical wall 100 and the horizontal ceiling 200 are defined by drywall panels having gypsum cores and having paper faces. Thus, the planar portion 20 extends horizontally, beneath and along the horizontal ceiling 200, to which the planar portion 20 is attached. In a preferred implementation via an adhesive means 70, such as a sprayed adhesive or a double-faced, adhesive tape. Trim-Tex 847™ Spray Adhesive, which is available commercially from Trim-Tex, Inc. of Lincolnwood, Ill., is a preferred means.

As illustrated in FIG. 2, the proximal edge 24 of the planar portion 20 is proximal to the vertical wall 100. Also, the additional flange extends along the vertical wall, toward the mounting flange. Also, the mounting flange 40 extends downwardly, along the vertical wall 100, away from the horizontal ceiling 200. Moreover, the additional flange 50 extends downwardly, beside and along the vertical wall 100, toward the mounting flange 40. Moreover, the flexible fin 60 bears upwardly against the horizontal ceiling 200, so as to close a pocket 62 formed where the distal edge 32 of the intermediate portion 30 adjoins the distal edge 22 of the planar portion 20.

Furthermore, this contemplates that, when the crown molding member 10 is installed in the first mode when drywall-finishing material 80, the mounting flange 40 is attached to the vertical wall 100 via mechanical fasteners 80, such as wire staples with diverging legs, one such staple being shown. Moreover, when drywall-finishing material 90, so-called "mud" in trade parlance, is applied to the mounting flange 40, some of the applied material 90 can be then pressed through at least some of the apertures 46, against the vertical wall 100. The step 44 facilitates spreading of such material 90 with a drywall-finishing blade.

As illustrated in FIG. 4, the crown molding member 10 is installed in a second mode, so as to trim the interior corner where the vertical wall 100 and the horizontal ceiling 200 meet. Thus, the planar portion 20 extends downwardly, beside and along the horizontal wall 100, to which the planar portion 20 is attached via the adhesive means 70. Also, the proximal edge 24 of the planar portion 20 is proximal to the wall 100. Moreover, the additional flange 50 extends downwardly, beside and along the vertical wall 100, toward the mounting flange 40. Moreover, the flexible fin 60 bears laterally against the vertical wall 100, so as to close a pocket 62 formed where the distal edge 32 of the intermediate portion 30 adjoins the distal edge 22 of the planar portion 20.

Furthermore, this invention contemplates that, when the crown molding member 10 is installed in the second mode, the mounting flange 40 is attached to the horizontal ceiling 200 via mechanical fasteners 80, such as wire staples with diverging legs, one such staple being shown. Moreover, when drywall-finishing material 90, so-called "mud" in trade parlance, is applied to the mounting flange 40, some of the applied material 90 can be then pressed through at least some of the apertures 46, against the horizontal ceiling 200. The step 44 facilitates spreading of such material 90 with a drywall-finishing blade.

Figure 7:
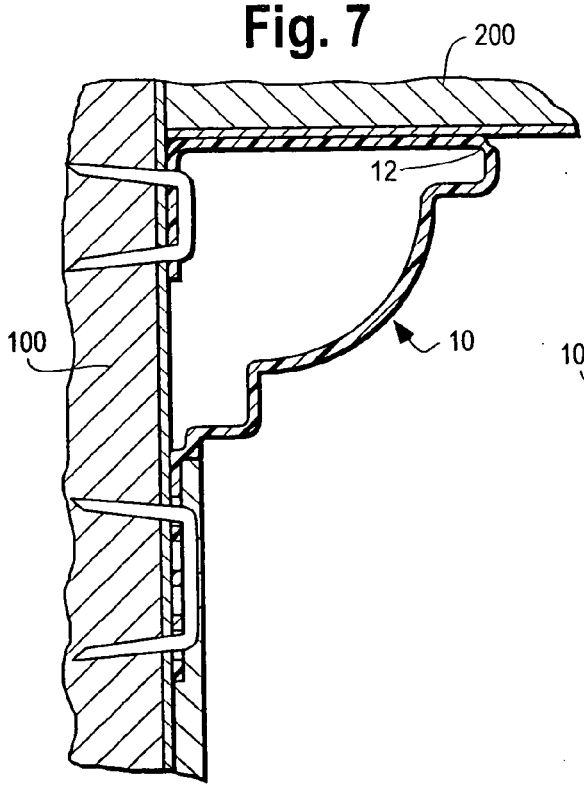
FIG. 7 is a sectional view, which is taken similarly, and which shows the crown molding member, as installed in a third implementation of the first mode, so as to trim an interior corner where a wall and a ceiling meet.

As illustrated in FIG. 5, the crown molding member 10 is installed in the first mode, in a second implementation differing from other implementations of the first mode, as discussed herein, in that the planar portion 20 is attached to the horizontal ceiling 200 via mechanical fasteners 80, such as wire staples with diverging legs, one such staple being shown. As illustrated in FIG. 7, the crown molding member 10 is installed in the first mode, in a third implementation differing from other implementations of the first mode, as discussed herein, in that the additional flange 50 is attached to the vertical wall 100 via mechanical fasteners 80, such as wire staples with diverging legs, one such staple being shown. As illustrated in FIG. 7, the additional flange 50 is lengthened so as to accommodate such fasteners 80. In the second or third implementation of the second mode, the planar portion 20 may be also attached adhesively to the horizontal ceiling 200, as described above.

Figure 6:
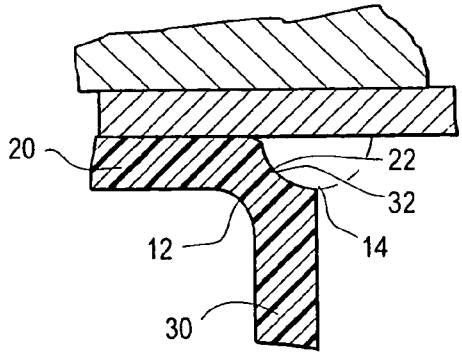
FIG. 6, on a larger scale, is a detail taken where indicated in FIG. 5.

As illustrated in FIGS. 5, 6, and 7, so as to facilitate flexing of the crown molding member 10 for entry of a fastener-driving tool, the crown molding member 10 is thinner, as compared to the generally uniform thickness discussed above, so as to form a so-called "living" hinge 12 where the distal edge 32 of the intermediate portion 30 adjoins the distal edge 22 of the planar portion 20. As illustrated in a broken line in FIG. 6, a caulk bead 14 may be optionally applied along crown molding member 10, where the so-called "living" hinge 12 is formed, so as to adhere to the horizontal ceiling 200, after the crown molding member 10 has been installed in the second or third implementation of the second mode.

Figure 8:
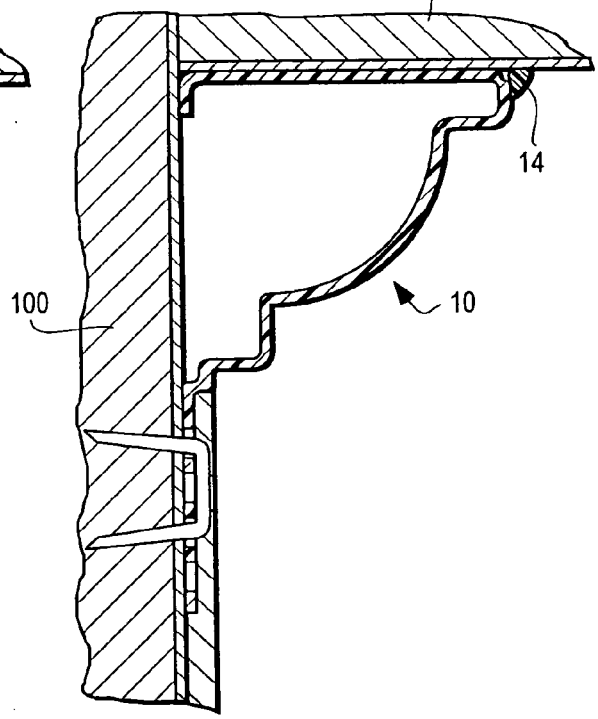
FIG. 8 is a sectional view, which is taken similarly, and which shows the crown molding member, as installed in a third implementation of the first mode, so as to trim an interior corner where a wall and a ceiling meet.

As illustrated in FIG. 8, the crown molding member 10 is installed in the first mode, in a fourth implementation differing from other implementations of the first mode, as discussed herein, in that a caulk bead 14 is applied along the crown molding member 10, where the distal edge 32 of the intermediate portion 30 adjoins the distal edge 22 of the planar portion 20, so as to adhere to the horizontal ceiling 200, after the crown molding member 10 has been installed. In the fourth implementation of the second mode, the planar portion 20 may be also attached adhesively to the horizontal ceiling 200, as described above.

As discussed above, the crown molding member is extruded from polyvinyl chloride. Thus, whether the crown molding member 10 is installed in the first mode, as described above, or in the second mode, as described above, the crown molding member 10 has sufficient flexibility to provide an expansion joint, which conceals a small gap if and when created, as by settling or shifting, at the corner where the vertical wall 100 and the horizontal ceiling 200 meet.

As illustrated in the drawings and described herein, the first mode in its various implementations is differentiated from the second mode because of the rotational orientation of the crown molding member 10 relative to an imaginary axis, which is parallel to the vertical wall 100 and to the horizontal ceiling 200.

The invention claimed is:

1. A combination comprising a vertical wall, a horizontal ceiling meeting the vertical wall so as to define a corner, and a crown molding member trimming the corner, the crown molding member having a planar portion, which extends along and is attached the horizontal ceiling, the planar portion having a proximal edge and a distal edge, which is spaced from the proximal edge of the planar portion, the crown molding member having an intermediate portion, which adjoins the distal edge of the planar portion at a distal edge of the intermediate portion, the intermediate portion having a proximal edge, which is spaced from the distal edge of the intermediate portion, the crown molding member having a mounting flange, which adjoins the proximal edge of the intermediate strip at an adjoining edge of the mounting flange, which extends along and is attached to the vertical wall, away from the horizontal ceiling, and which has an array of apertures.

2. The combination of claim 1, wherein the combination further comprises drywall-finishing material, which is applied to the mounting flange so that some of the applied material is pressed through at least some of the apertures, against the vertical wall.

3. The combination of claim 2, wherein the mounting flange is attached to the vertical wall adhesively or mechanically, as well as by the applied material.

4. The combination of claim 1, wherein the planar portion is attached to the horizontal ceiling adhesively or mechanically.

5. The combination of claim 1, wherein the mounting flange is attached to the vertical wall adhesively or mechanically.

6. The combination of claim 1, wherein the planar portion is attached to the horizontal ceiling adhesively or mechanically and wherein the mounting flange is attached to the vertical wall adhesively or mechanically.

7. The combination of claim 1, 2, 4, 5, 6, or 3, wherein the planar portion extends approximately to the vertical wall.

8. A combination comprising a vertical wall, a horizontal ceiling meeting the vertical wall so as to define a corner, and a crown molding member trimming the corner, the crown molding member having a planar portion, which extends along and is attached to the vertical wall, the planar portion having a proximal edge and a distal edge, which is spaced from the proximal edge of the planar portion, the crown molding member having an intermediate portion, which adjoins the distal edge of the planar portion at a distal edge of the intermediate portion, the intermediate portion having a proximal edge, which is spaced from the distal edge of the intermediate portion, the crown molding member having a mounting flange, which adjoins the proximal edge of the intermediate strip at an adjoining edge of the mounting flange, which extends along and is attached to the horizontal ceiling, away from the vertical wall, and which has an array of apertures, wherein the combination further comprises drywall-finishing material, which is applied to the mounting flange so that some of the applied material is pressed through at least some of the apertures, against the horizontal ceiling.

9. The combination of claim 8, wherein the planar portion is attached to the vertical wall adhesively or mechanically.

10. The combination of claim 8, wherein the mounting flange is attached to the horizontal ceiling adhesively or mechanically.

11. The combination of claim 8, wherein the planar portion is attached to the vertical wall adhesively or mechanically and wherein the mounting flange is attached to the horizontal ceiling adhesively or mechanically.

12. The combination of claim 8, wherein the mounting flange is attached to the vertical wall adhesively or mechanically, as well as by the applied material.

13. The combination of claim 8, 9, 10, 11, or 12, wherein the planar portion extends approximately to the horizontal ceiling.

* * * * *